US007750754B2

(12) United States Patent
Russer et al.

(10) Patent No.: US 7,750,754 B2
(45) Date of Patent: Jul. 6, 2010

(54) BASE UNIT AND DEVICE FOR THE TRANSFER OF ELECTROMAGNETIC FIELDS

(75) Inventors: Peter Russer, Munich (DE); Michael Zedler, Kraepelinstrasse 63, 80804 Munich (DE)

(73) Assignee: Michael Zedler (CA)

( * ) Notice: Subject to any disclaimer, the term of this patent is extended or adjusted under 35 U.S.C. 154(b) by 26 days.

(21) Appl. No.: 12/138,519

(22) Filed: Jun. 13, 2008

(65) Prior Publication Data

US 2009/0066442 A1 Mar. 12, 2009

Related U.S. Application Data

(63) Continuation of application No. PCT/DE2006/002227, filed on Dec. 13, 2006.

(30) Foreign Application Priority Data

Dec. 13, 2005 (DE) ..... 10 2005 059 392

(51) Int. Cl.
*H01P 1/04* (2006.01)

(52) U.S. Cl. ..... 333/24 R

(58) Field of Classification Search ..... 333/24 R
See application file for complete search history.

(56) References Cited

U.S. PATENT DOCUMENTS 7,075,371 B2 * 7/2006 Aoki et al. ..... 330/276

FOREIGN PATENT DOCUMENTS

EP 1596470 A1 11/2005
WO 2006023195 A2 3/2006

OTHER PUBLICATIONS

Du H , et al : Modeling of Metamaterials With Negative Refractive Index Using 2-D Shunt and 3-D SCN TLM Networks IEEE Transactions on microwave theory and techniques, IEEE Service Center, Piscataway, NJ, US, vol. 53, No. 4, Apr. 2005, pp. 146 1505.

Grbic, A , Eleftheriades, G. V "An isotropic three-dimensional negative-refractive-index transmission-line metamaterial" In Journal of Applied Physics, vol. 98, 043106(2005).

Hoefer W., et al: "Topology and Design of Wide-Band 3D Metamaterials Made of Periodically Loaded Transmission Line Arrays" Microwave Symposium Digest, 2005 IEEE MTT-S International Long Beach, CA, USA, Jun. 12-17, 2005, Piscataway, NJ, USA, IEEE, Jun. 12, 2005, pp. 313-316.

(Continued)

*Primary Examiner*—Robert Pascal
*Assistant Examiner*—Alan Wong
(74) *Attorney, Agent, or Firm*—St. Onge Steward Johnston & Reens LLC

(57) ABSTRACT

A metamaterial is proposed which is composed of base elements having six ports with two ports, respectively. The base element further comprises four nodes connected with a central point via inductors, to which nodes the ports are connected via capacitors.

14 Claims, 9 Drawing Sheets

OTHER PUBLICATIONS

International Search Report, PCT/DE2006/002227, Mar. 21, 2007, 3 pages.

International Preliminary Report on Patentability, PCT/DE2006/002227, Jul. 17, 2008, 2 pages.

Lai, A.; Itoh, T.: "Complete Right/Left-Handed Transmission Line Metamaterials" In IEEE Microwave Magazine, Sep. 2004, pp. 34-50.

Pendry, J. B.: "Negative refraction"; Contemporary Physics, Jan.-Feb. 2004, vol. 45, No. 3, pp. 191-202.

Sanada, A , et al.: "Characteristics of the composite right/left-handed transmission lines" IEEE Microwave and wireless components letters, IEEE Service Center, New York, NY, USA, vol. 14, No. 2, Feb. 2004, pp. 68-70.

So P. P. M , et al : "Time domain TLM modeling of metamaterials with negative refractive index", Microwave Symposium Digest, 2004 IEEE MTT-S International Fort Worth, TX, USA Jun. 6-11, 2004, Piscataway, NJ, USA, IEEE, vol. 3, Jun. 6, 2004, pp. 1779-1782.

Written Opinon of the International Searching Authority, PCT/DE2006/002227, Jul. 8, 2008, 6 pages.

Zedler, M., Russer P.. "Investigation on the dispersion relation of a 3-D LC-based metamaterial with an omnidirectional left-handed frequency band" 2006, IEEE MTT-S International Microwave Symposium Digest, Jun. 11, 2006-Jun. 16, 2006, pp. 1477-1479, San Francisco, CA, USA.

* cited by examiner

A cell

B cell

BASE UNIT AND DEVICE FOR THE TRANSFER OF ELECTROMAGNETIC FIELDS

CROSS-REFERENCE TO RELATED APPLICATIONS

The present application is a continuation of pending International patent application PCT/DE2006/002227 filed on Dec. 13, 2006 which designates the United States and claims priority from German patent application 10 2005 059 392.5 filed on Dec. 13, 2005, the content of which is incorporated herein by reference.

FIELD OF THE INVENTION

The invention relates to a base unit for the transmission of electro-magnetic fields with six ports having two poles, respectively.

Furthermore, the invention relates to a device for the transmission of electromagnetic fields.

BACKGROUND OF THE INVENTION

Such a device is known from GRBIC, A.; ELEFTHERIADES, G. V.: An isotropic three-dimensional negative-refractive-index transmission-line metamaterial. In: Journal of Applied Physics, VOL. 98, 043106 (2005). The known device comprises a base unit with a plurality of ports having two poles, respectively. Metamaterials having a negative refractive index can be provided using the base unit.

Metamaterials are artificial structures exhibiting both negative dielectricity coefficients as well as negative permeability coefficients in certain frequency ranges. An extensive survey on metamaterials is given, for example, in the publication by LAI, A.; ITOH, T.: Complete Right/Left-Handed Transmission Line Metamaterials. In: IEEE Microwave Magazine, September 2004, pp. 34-50. Metamaterials are composed of base units set up next to each other.

Lenses whose resolution is lower than the resolution limits of $\lambda/2$ can be constructed, in principle, using metamaterials. Furthermore, antennas which have a higher sensitivity than conventional antennas are conceivable. Finally, the development of materials is also conceivable, which guide radiation incident on a body around the body free of reflection, so that the body cannot be detected by the reflected or scattered portions of the incident electromagnetic radiation.

In particular, it could thus be possible to develop materials that cannot be detected by radar.

Based on this prior art, the invention is therefore based on the object of providing base units and devices for the transmission of electromagnetic fields that are suitable for metamaterials.

SUMMARY OF THE INVENTION

This object is achieved by a base unit and a device having the features of the independent claims. Preferred embodiments and developments are specified in the claims dependent thereon.

The base unit for the transmission of electromagnetic fields has six ports having two poles, respectively. In addition, there are four nodal points connected with a central point via inductors, wherein the ports can be grouped into three pairs whose poles are respectively connectable to different nodal points via capacitors.

It was possible to show that devices with a plurality of such base units have negative refractive indices in broad frequency ranges.

Preferably, the base unit is formed as a three-dimensional cell, so that the devices composed of the base units are suitable for spatial applications.

Furthermore, the base unit preferably has a cuboid structure, which facilitates setting up the base units next to each other.

Devices for the transmission of electromagnetic fields based on the base unit preferably comprise two complementary types of base unit, which are hereinafter referred to as A cell and B cell. The A cells and B cells can be set up next to each other in series, with A cells respectively connected to B cells and B cells respectively connected with A cells. This structure suggests itself if the A cells and B cells must be realized separately.

The A cell is a six-port unit cell for transmission of electromagnetic fields wherein the A cell has a 3-dimensional cell structure. The 3-dimensional structure of the A cell is depicted with respect to an orthogonal right-handed coordinate system. The A cell comprises 6 ports, each port having two nodes. The direction of an electrical field between the nodes of each port can be shown aligned in various directions. The B cell is a six-port unit cell for transmission of electromagnetic field that is complementary to the A cell.

BRIEF DESCRIPTION OF THE DRAWINGS

Other properties and advantages of the invention become apparent from the following description in which exemplary embodiments of the invention are explained in detail with reference to the accompanying drawing. In the figures.

DETAILED DESCRIPTION OF THE INVENTION

Figure 1:
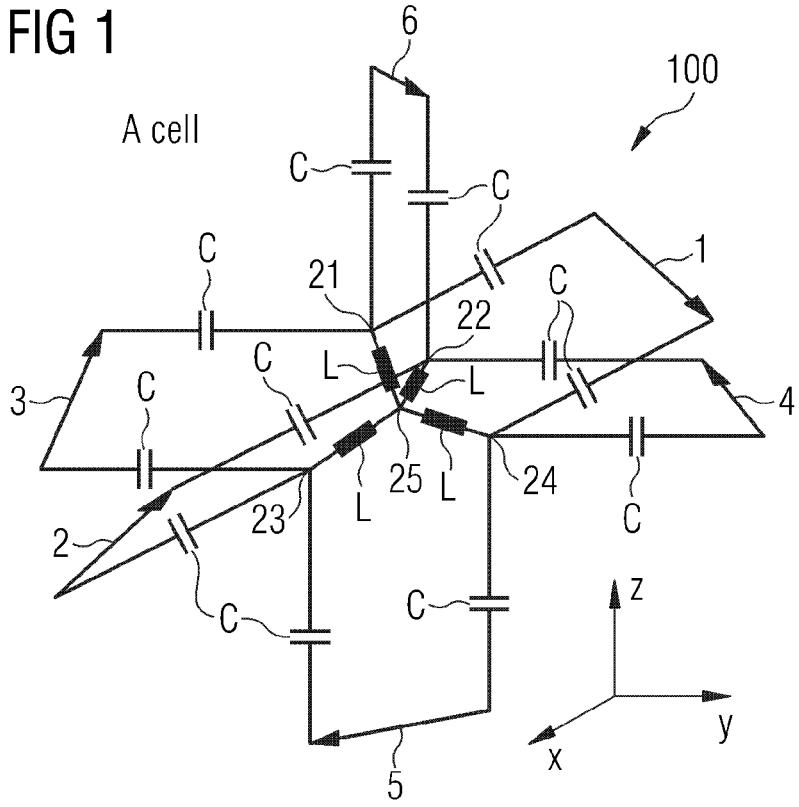
FIG. 1 shows the structure and the circuit of a first unit cell.
Figure 2:
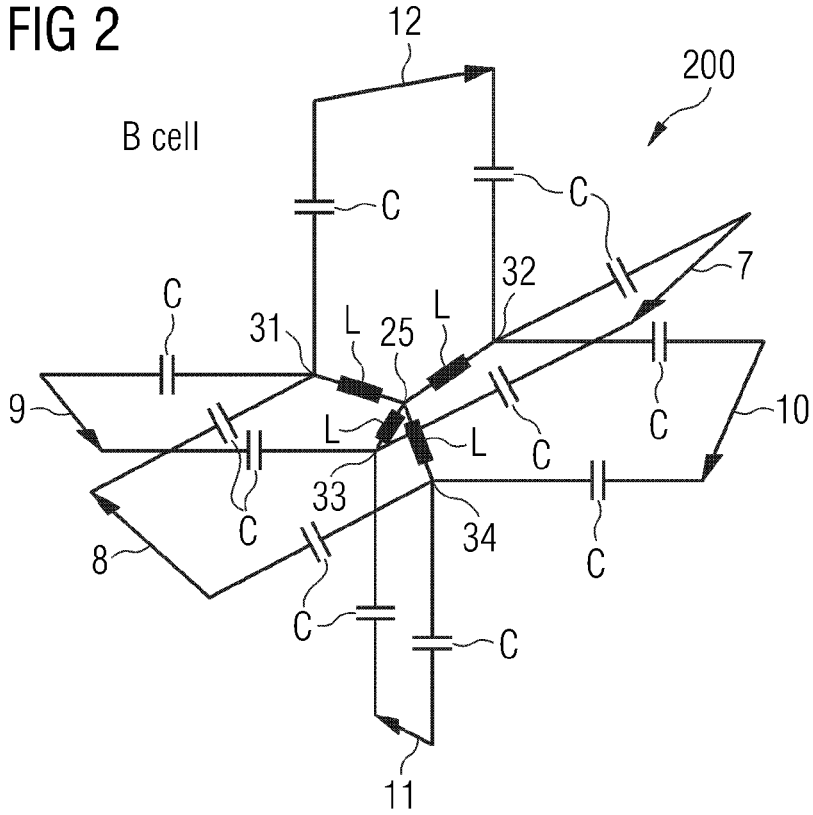
FIG. 2 shows the structure and the circuit of a second unit cell.

FIGS. 1 and 2 show the schematic representations of the geometry and circuitry of a first unit cell 100 and a second unit cell 200. Each of the two unit cells 100 and 200 is a six-port. The first unit cell 100 will hereinafter be referred to as A cell and the unit cell 200 as B cell. The A cell of FIG. 1 comprises six ports denoted 1 to 6. From these ports, conductors run to the nodes 21, 22, 23 and 24. A capacitor C is inserted into each of the twelve conductors from the ports 1 to 6 to the nodes 21 to 24. Each of the four nodes 21 to 24 is connected with a central node 25 via an inductor L. The drawing not only schematically represents the circuit diagram, but also the geometrical arrangement of the lines. The arrows drawn into the ports represent the reference arrows for the port voltages and also indicate the direction of the electrical field between the two nodes of the respective port. The electrical field between the nodes of port 1 is oriented in the [0, 1,−1] direction, the electrical field between the nodes of port 2 is oriented in the [0,1,1] direction. The electrical field between the nodes of port 3 is oriented in the [−1,0, 1] direction and the electrical field between the nodes of port 4 is oriented in the [1,0,1] direction. The electrical field between the nodes of port 5 is oriented in the [1,−1,0] direction and the electrical field between the nodes of port 6 is oriented in the [1,1,0] direction.

It should be noted that the indication of the direction is given in relative coordinates. If the [0, 1,−1] direction is attributed to the direction of the electrical field between the nodes of port 1, the direction of the electrical field between the nodes of port 2 must be oriented in the [0,1,1] direction and so on.

The B cell 200 shown in FIG. 2 has a geometrically complementary arrangement with regard to the A cell. The unit cell 200 has ports 7 to 12 which are connected to internal nodes 31 to 34 via capacitors C. The circuit configuration of the B cell with capacitors C and inductors L corresponds to the circuit configuration of the unit cell 100. However, the polarizations at the ports 7 to 12 are rotated by 90° compared with the A cell. For example, the polarization of the electrical field in port 7 is oriented in the [0,−1, 1] direction.

Figure 3:
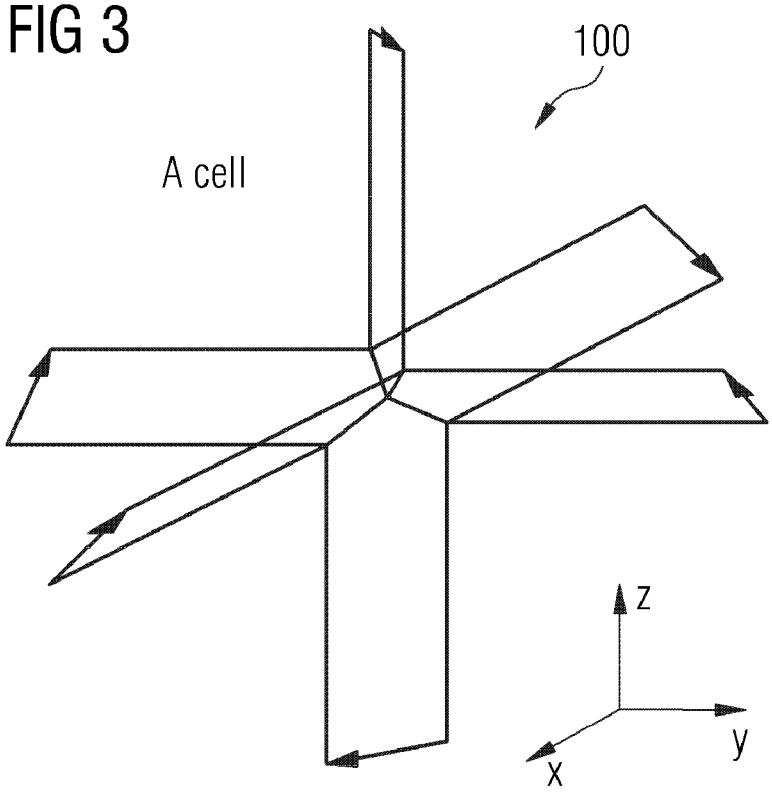
FIG. 3 shows a simplified representation of the first unit cell from FIG. 1.
Figure 4:
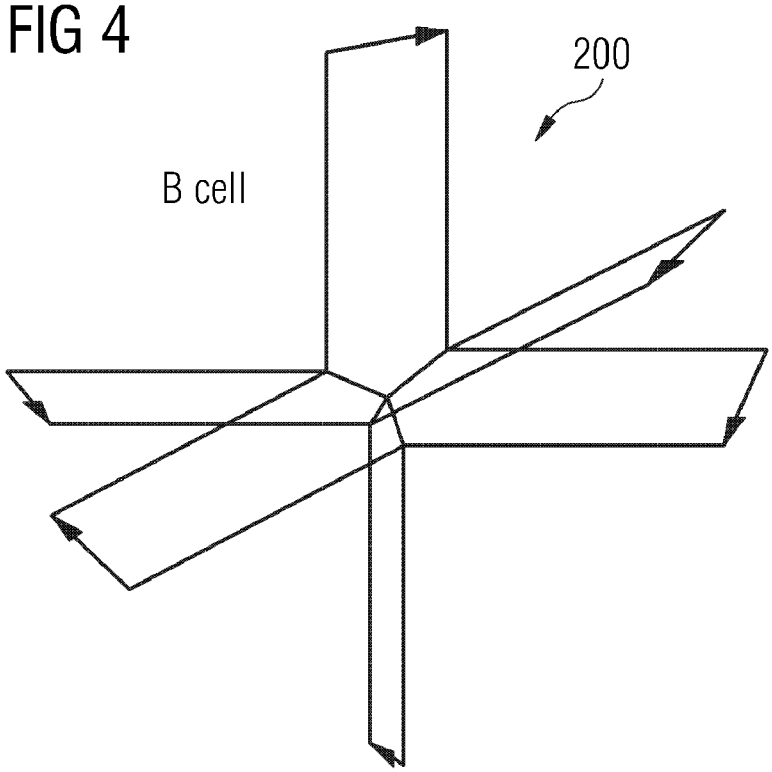
FIG. 4 shows a simplified representation of the second unit cell from FIG. 2.
Figure 5:
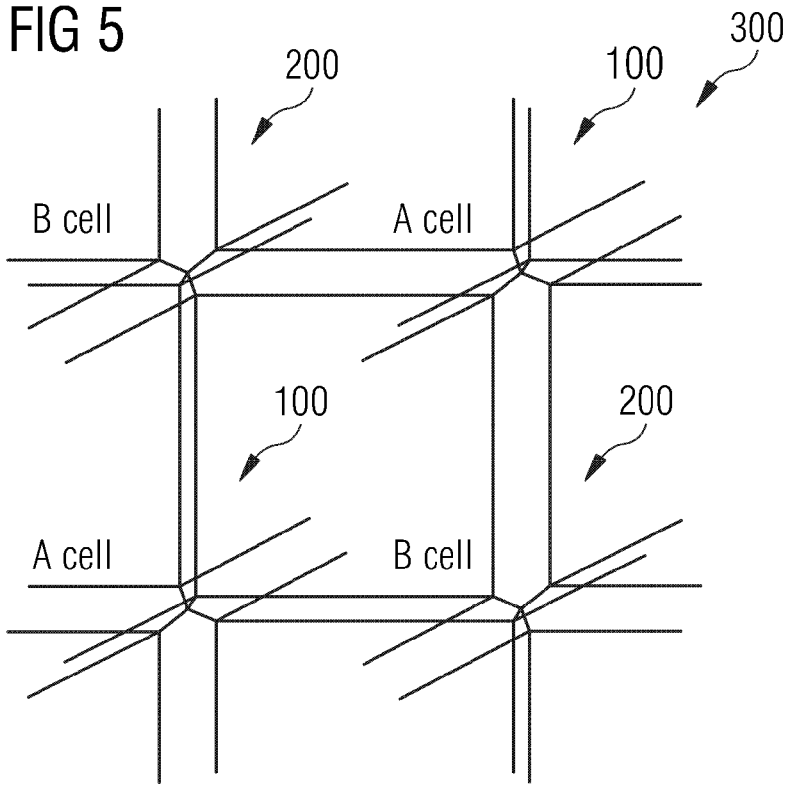
FIG. 5 shows an arrangement comprising two first and two second unit cells.
Figure 6:
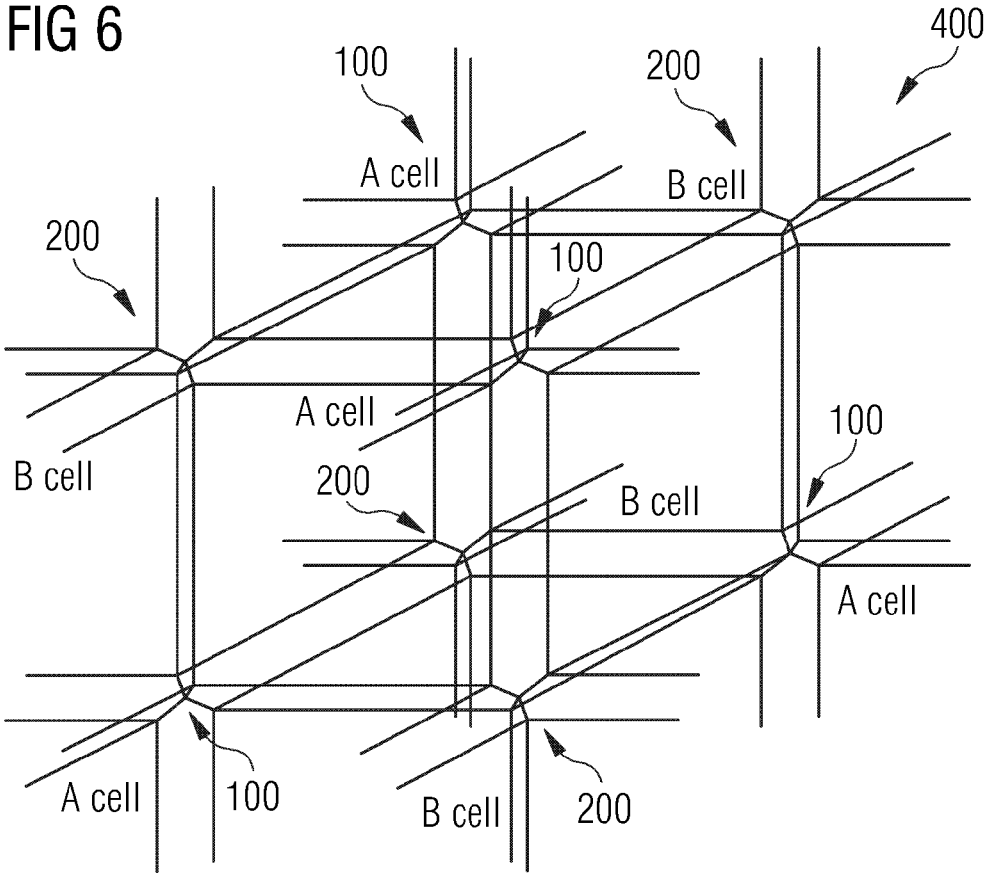
FIG. 6 shows an arrangement comprising four first and four second unit cells.
Figure 7:
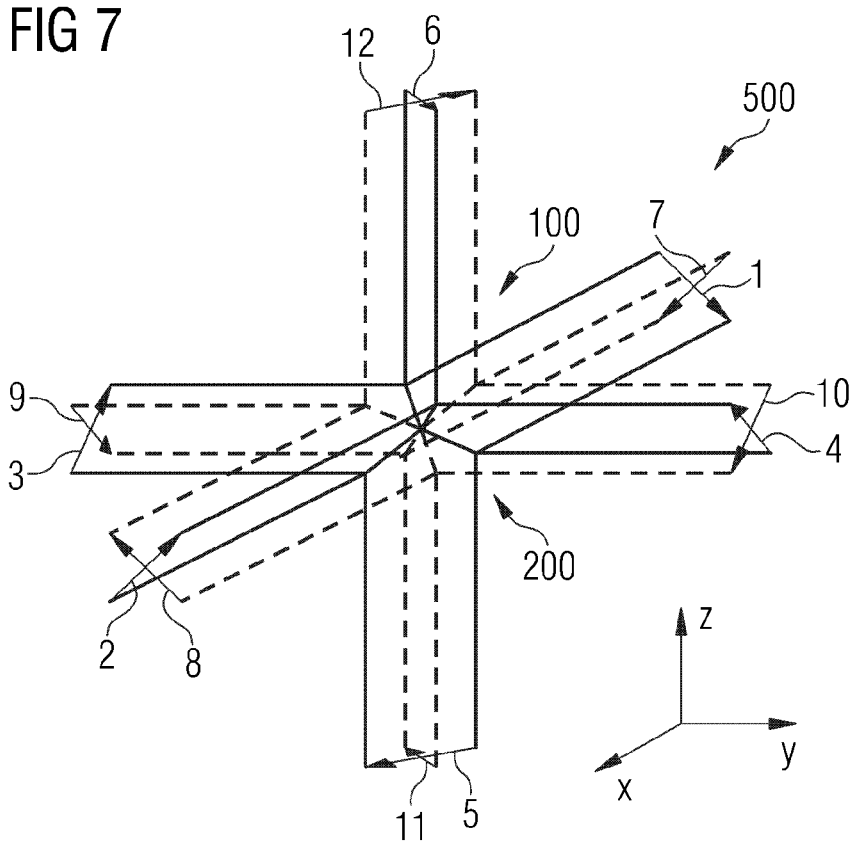
FIG. 7 shows the representation of a merged unit cell.

In the following, the schematic representation of the A cells and B cells according to FIG. 3 and FIG. 4 is used, with the capacitors and inductors not drawn in for the purpose of simplifying the representation. In all cases, however, the capacitors C and inductors L are included in the branches, corresponding to FIGS. 1 and 2.

The A cell is a six-port unit cell for transmission of electromagnetic fields wherein the A cell has a 3-dimensional cell structure as shown in FIGS. 1 and 3. In FIGS. 1 and 3, the 3-dimensional structure of the A cell is depicted with respect to an orthogonal right-handed coordinate system. As shown in FIG. 1, the A cell comprises 6 ports, each port having two nodes. The direction of an electrical field between the nodes of each port is shown aligned in various directions according to the arrows shown in FIG. 1.

The B cell is a six-port unit cell for transmission of electromagnetic field that is complementary to the A cell. The 3-dimensional cell structure of a B cell is shown in FIGS. 2 and 4.

Figure 8:
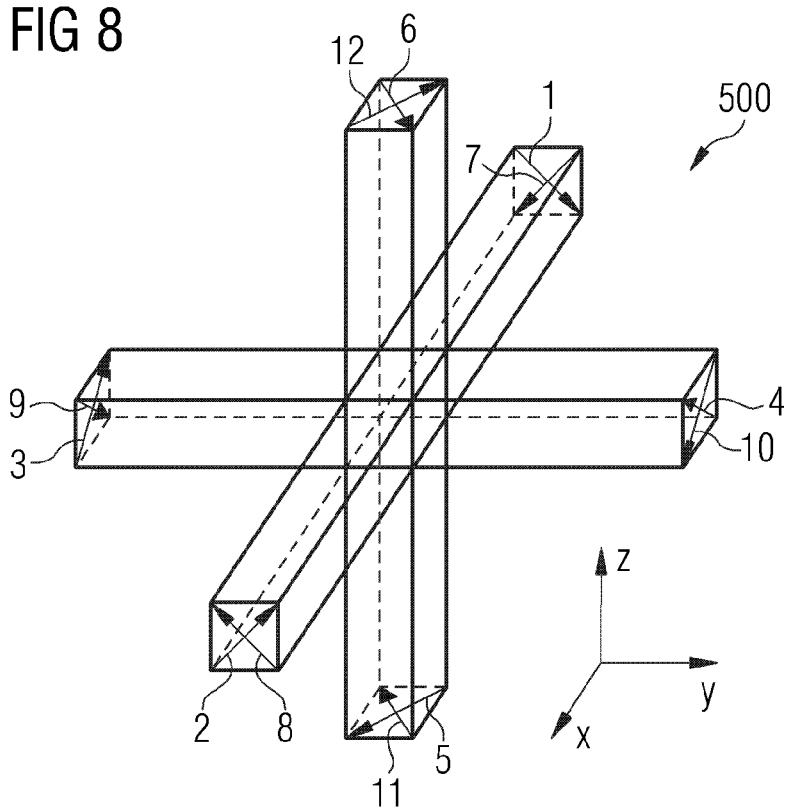
FIG. 8 shows the enlarged representation of the ports of the unit cell from FIG. 7.

FIG. 8 shows a simplified representation of the combined unit cell 500. It can be seen from FIG. 8 that the electromagnetic radiation incident on the basic cell 500 from any direction in space can be transmitted by it. Furthermore the relative orientation of the electrical fields between the nodes of the ports 1 to 6 and 7 to 12 with respect to an orthogonal reference system can be recognized.

Figure 9:
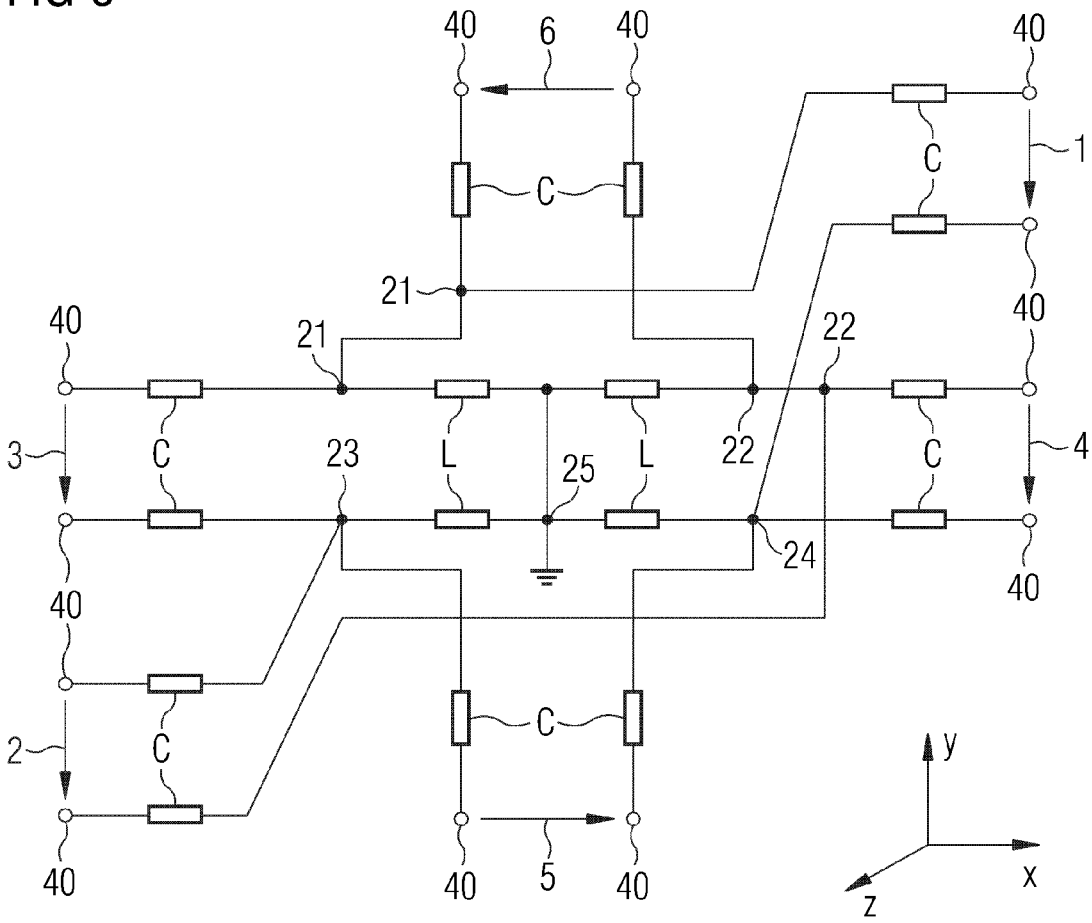
FIG. 9 shows a representation of the circuit of a unit cell projected onto a plane.

Finally, a circuit of the unit cell 100 projected onto a plane is shown in FIG. 9. It can be seen from FIG. 9 that the ports 1 to 6 each have two poles 40. In addition, the circuit arrangement becomes clear in detail.

Simulation calculations were performed and experiments carried out for proving suitability for metamaterial. The setup of the experiment shall be explained with reference to FIGS. 10 to 13.

Figure 10:
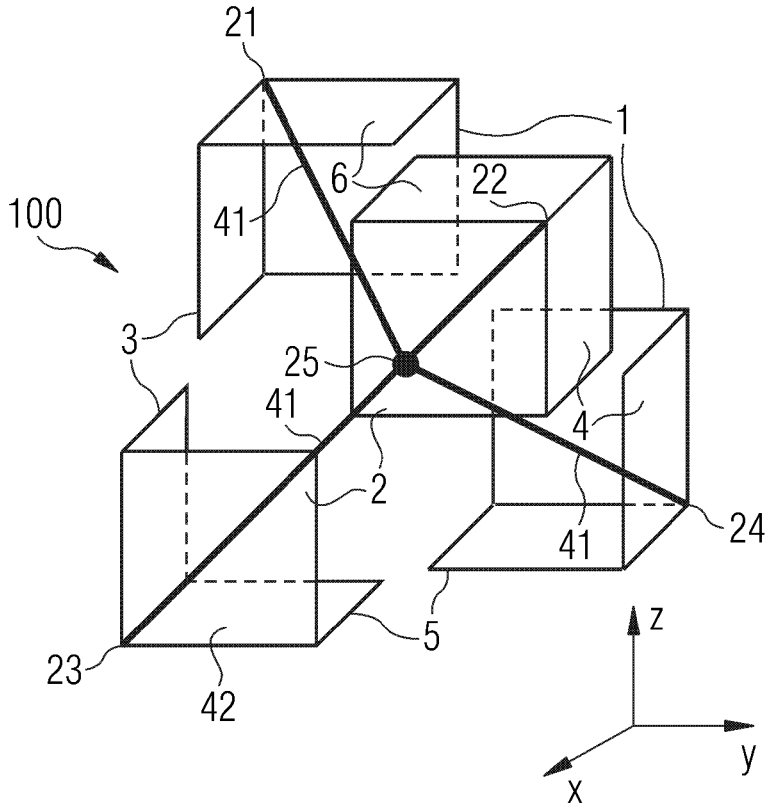
FIG. 10 shows the representation in perspective of a realized first unit cell.

FIG. 10 shows a view in perspective of the unit cell 100 in a concrete realization. In the unit cell 100 shown in FIG. 10, lines 41, starting from the central node 25, lead to the internal nodes 21 to 24, which are located at the corners of the cube. The lines 41 assume the function of the inductors L. Furthermore, plate capacitors 42 are disposed in the corners of the cube, which are connected in the corners to the allocated nodes 21 to 24. The outer surfaces of the plate capacitors 42, which on the side surfaces of the cube are disposed diagonally opposite, each form the poles of one of the ports 1 to 6.

It should be noted that the edges of the plate capacitors do not touch each other. Only in the nodes 21 to 24 is there a connection between the internal electrodes of the plate capacitors 42.

Figure 11:
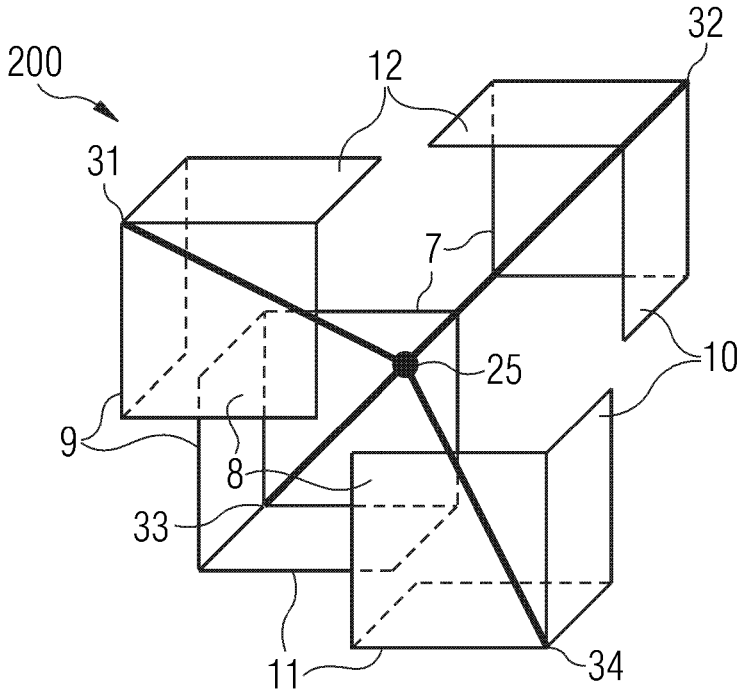
FIG. 11 shows the representation in perspective of a realized second unit cell.

FIG. 11 shows the structure of the unit cell 200 complementary to the unit cell 100. What was said with regard to FIG. 10 applies here correspondingly.

Figure 12:
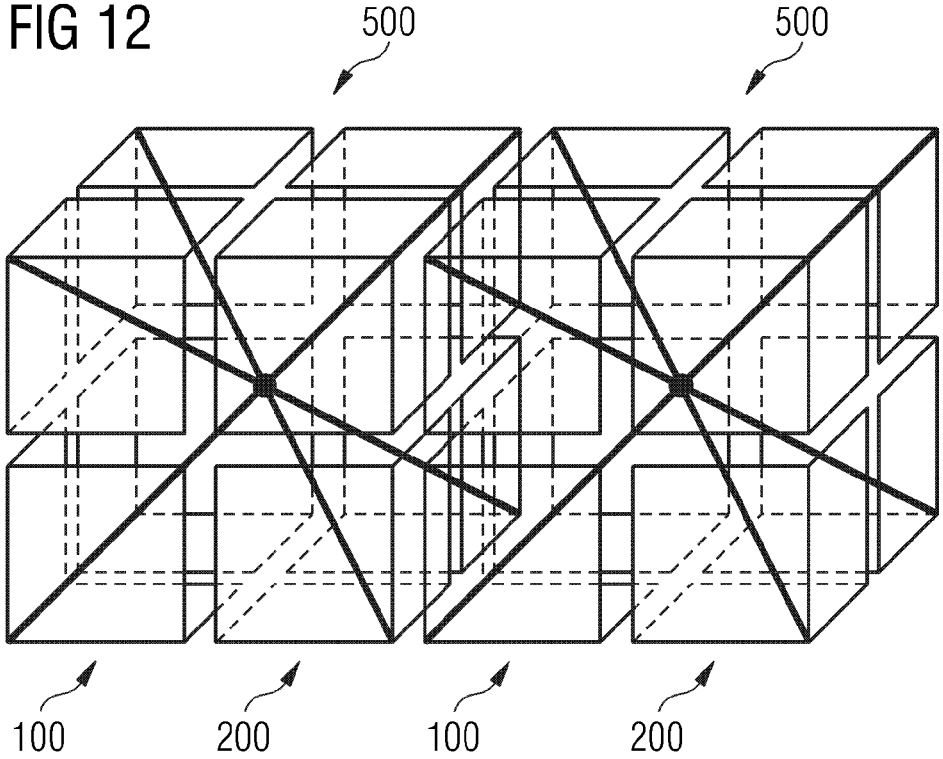
FIG. 12 shows the representation in perspective of a realized combination of the first and the second unit cell.

It can be seen from FIG. 12 that the unit cell 100 and the unit cell 200 can be composed to form the basic cell 500.

Figure 13:
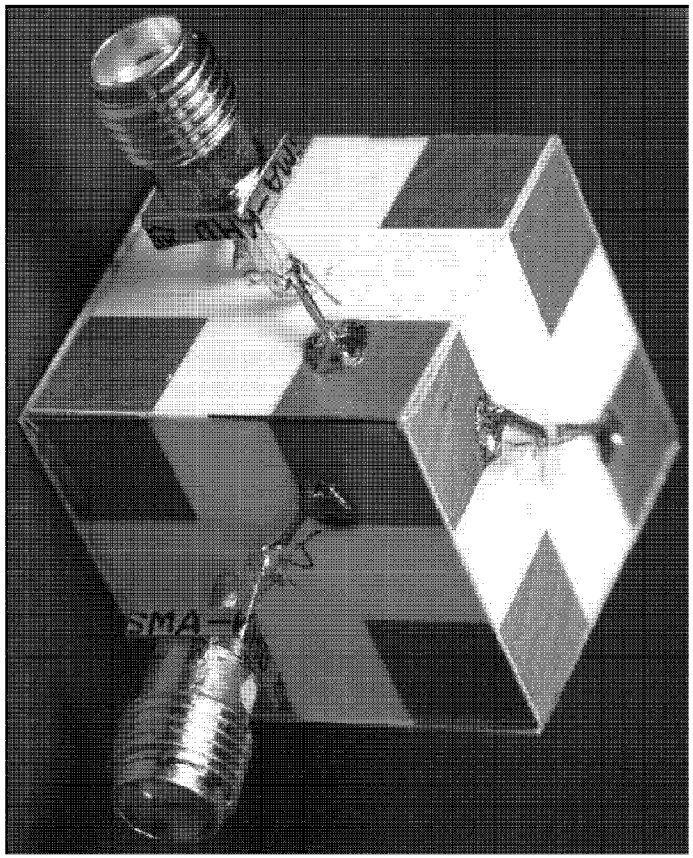
FIG. 13 shows a photograph of a unit cell used for measurements.

Finally, FIG. 13 is a representation of a concrete experimental setup for investigating the unit cell 100 or 200, in which two ports have been equipped with terminals for cables, whereas the remaining four terminals have been terminated with Ohmic resistors.

Figure 14:
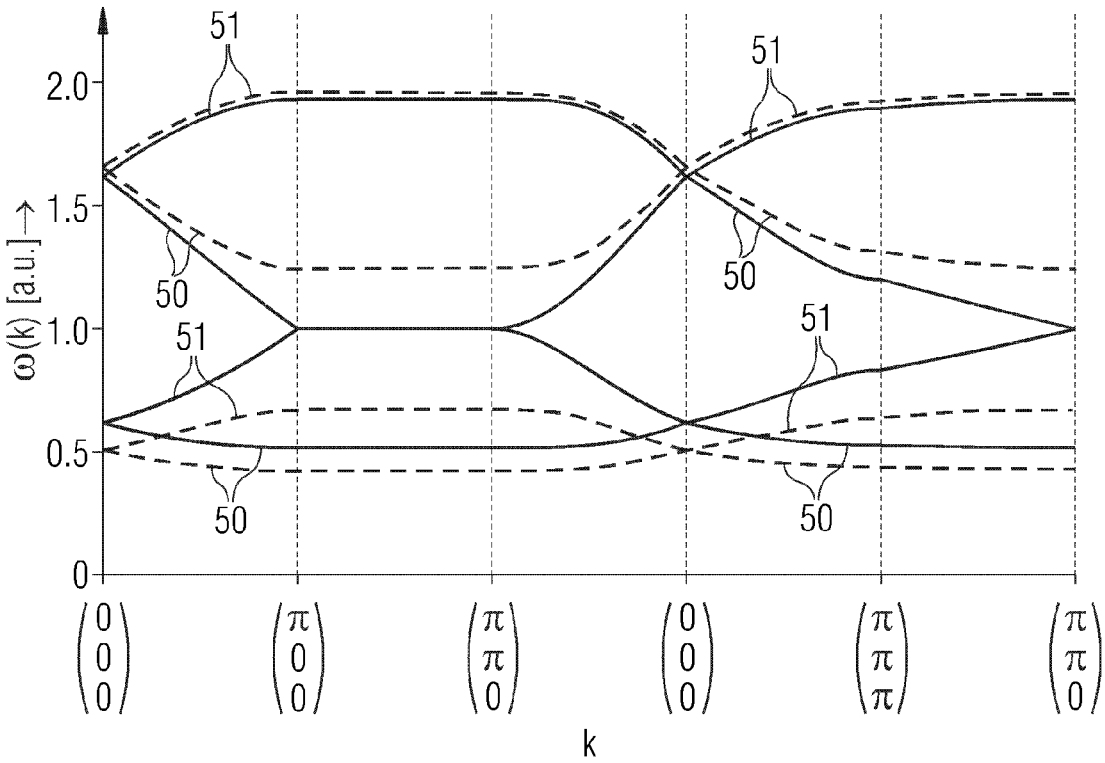
FIG. 14 shows a calculated dispersion diagram.

FIG. 14 shows a dispersion diagram showing the results of simulation calculations for determining the dispersion relation. FIG. 14 shows, in particular, the frequency $\omega$ plotted in arbitrary units against the wave vector k. It can be seen in FIG. 14 that two left-handed modes 50 and two right-handed modes 51 form, respectively. The mode located at higher frequencies here forms a particularly broad frequency band.

The left-handed modes are those modes having a negative group velocity. For example, the left-handed mode 50 has a negative slope in the area between k=(0,0, 0) to k=($\pi$,0,0), which results in a negative group velocity. A negative group velocity, however, is typical for metamaterials with a negative refractive index.

The dashed and the solid curves in FIG. 14 were each calculated using different parameter values, with parasitic quantities such as, for example, parasitic capacitors connected in parallel to the inductors L or parasitic inductors connected in series with the capacitors C also having been taken into account.

Figure 15:
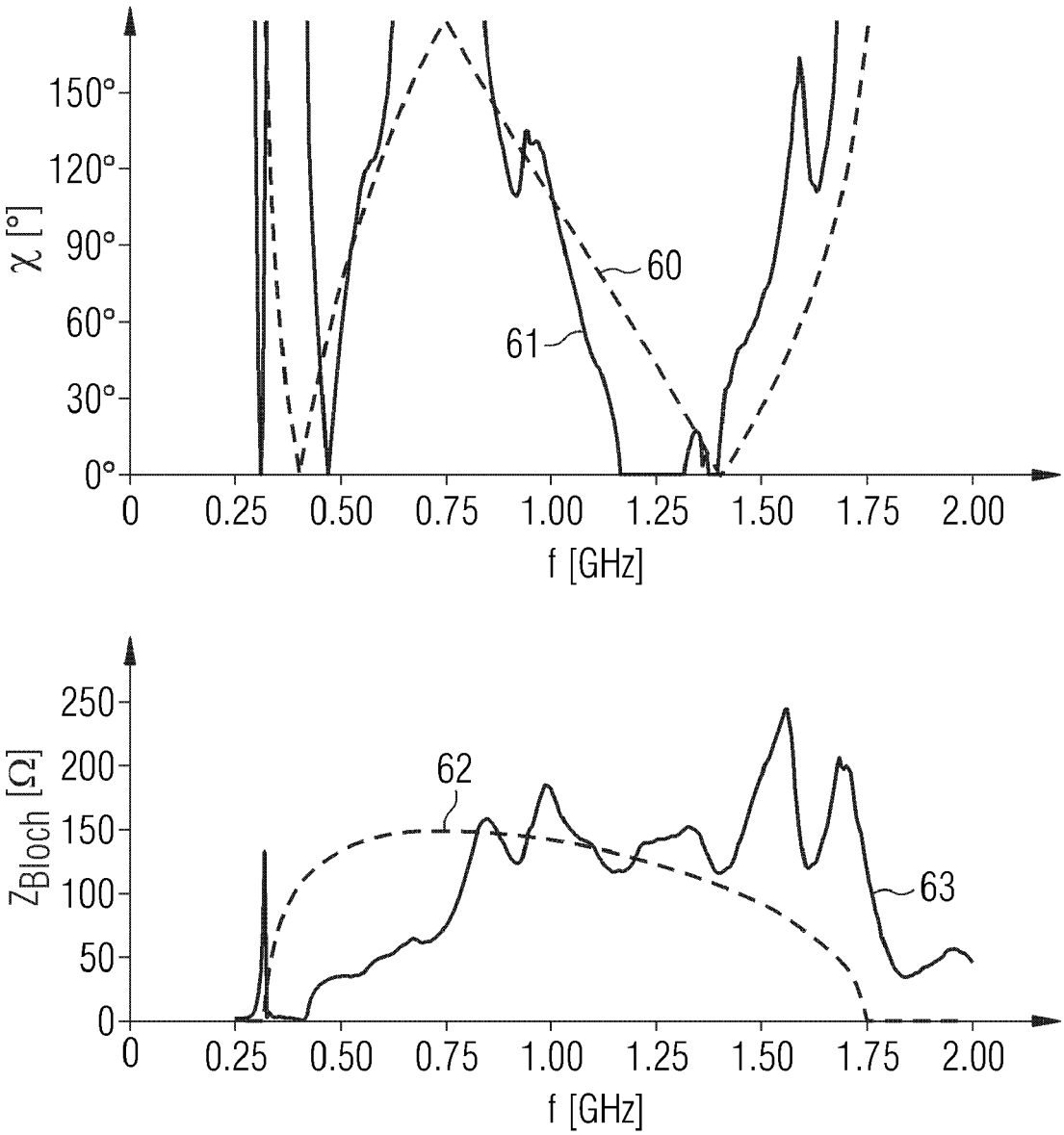
FIG. 15 shows another dispersion diagram combined with a representation of the wave impedance.

FIG. 15 in the top diagram again shows the dispersion relation from FIG. 14, the abscissa being the frequency axis and the coordinate representing the phase shift $\chi$. For the phase shift, $\chi=k_x \cdot a$ applies, with a being the size of the unit cell. The dashed curves 60 are the results of the simulation already shown in FIG. 14, whereas the solid curves 61 are the result of measurements.

In the lower diagram, the wave impedance is plotted against the frequency. A dashed curve 62 is the result of simulation calculations, whereas a solid curve 63 results from measurements. It becomes clear in FIG. 15 that, in the phase range between 0° and 90°, which corresponds to the frequency range between 1 and 1.4 GHz, a wave impedance of between 100 and 150 Ohms is to be expected, which makes an adjustment to the wave impedance of the vacuum appear possible.

What is claimed is:

1. Base unit for the transmission of electromagnetic fields with six ports having two poles, respectively, and with four nodes connected with a central point via inductor, wherein the ports can be grouped into three pairs whose poles are respectively connected to different ones of the four nodes via capacitors.

2. Base unit according to claim 1, wherein the base unit is formed as a three-dimensional cell.

3. Base unit according to claim 1, wherein the base unit is formed in a cuboid shape, with a different one of the six ports being allocated to every side of the cuboid.

4. Base unit according to claim 1, wherein the base unit is an A cell having a geometrical arrangement in which an electrical field at the six ports is respectively oriented in the directions [0, 1,−1], [0,1,1], [−1,0,1], [1,0,1], [1,−1,0] and [1, 1,0].

5. Base unit according to claim 1, wherein the base unit is an B cell having a geometrical arrangement in which an electrical field at the six ports is respectively oriented in the directions [0,−1,−1], [0,−1, 1], [−1,0,−1], [1,0,−1], [−1,−1,0] and [−1, 1,0].

6. Device for the transmission of electromagnetic fields, wherein the device comprises base units according to claim 1.

7. Device according to claim 6, wherein each of the base units is formed as a three-dimensional cell.

8. Device according to claim 6, wherein each of the base units is formed in a cuboid shape, with a different one of the six ports being allocated to every side of the cuboid.

9. Device according to claim 6, wherein each of the base units is an A cell having a geometrical arrangement in which an electrical field at the six ports is respectively oriented in the directions [0, 1,−1], [0, 1, 1], [−1,0, 1], [1,0, 1], [1,−1,0] and [1, 1,0].

10. Device according to claim 6, wherein each of the base units is an B cell having a geometrical arrangement in which an electrical field at the six ports is respectively oriented in the directions [0,−1,−1], [0,−1, 1], [−1,0,−1], [1,0,−1], [−1,−1,0] and [−1, 1,0].

11. Device according to claim 6, wherein the device comprises A cells and B cells and each A cell is only connected with corresponding B cells, and each B cell only connected with corresponding A cells, wherein each of the A cells is a base unit having a geometrical arrangement in which an electrical field at the six ports is respectively oriented in the directions [0, 1,−1], [0, 1, 1], [−1,0, 1], [1,0, 1], [1,−1,0] and [1, 1,0] and wherein each of the B cells is a base unit having a geometrical arrangement in which an electrical field at the six ports is respectively oriented in the directions [0,−1,−1], [0,−1, 1], [−1,0,−1], [1,0,−1], [−1,−1,0] and [−1, 1,0].

12. Device according to claim 6, wherein the device comprises a combined cell with twelve ports which is formed of an A cell and a B cell, respectively, which are spatially merged, wherein the A cell is a base unit having a geometrical arrangement in which an electrical field at the six ports is respectively oriented in the directions [0, 1,−1], [0, 1, 1], [−1,0, 1], [1,0, 1], [1,−1,0] and [1, 1,0] and wherein the B cell is a base unit having a geometrical arrangement in which an electrical field at the six ports is respectively oriented in the directions [0,−1,−1], [0,−1, 1], [−1,0,−1], [1,0,−1], [−1,−1,0] and [−1, 1,0].

13. Device according to claim 12, wherein the device comprises several combined cells.

14. Device according to claim 6, wherein the each of base units has the shape of a cuboid with inductive lines leading from the central point to the nodes, which are located at the corners of the cuboid, and with plate capacitors disposed in the corners of the side surface of the cuboid and connected in the corners to the associated nodes, the outer surfaces of plate capacitors disposed diagonally opposite forming the poles of the six ports.

* * * * *